US005694876A

United States Patent [19]

Ackermann et al.

[11] Patent Number: 5,694,876

[45] Date of Patent: Dec. 9, 1997

[54] FRONT ROLLER FEEDER

[75] Inventors: Manfred Ackermann, Elmhurst; Dale R. Carr, Belvidere, both of Ill.

[73] Assignee: One Union Special Corporation, Huntley, Ill.

[21] Appl. No.: 600,547

[22] Filed: Feb. 13, 1996

Related U.S. Application Data

[63] Continuation-in-part of Ser. No. 493,849, Jun. 20, 1995, Pat. No. 5,605,106.

[51] Int. Cl.[6] ..... D05B 27/16

[52] U.S. Cl. ..... 112/475.01; 112/318; 112/320; 112/153; 112/147

[58] Field of Search ..... 112/475.01, 153, 112/322, 147, 235, 306, 318, 320, 141

[56] References Cited

U.S. PATENT DOCUMENTS

| | | |
|---|---|---|
| 1,715,119 | 5/1929 | Clarkson . |
| 1,723,786 | 8/1929 | Jones . |
| 1,988,372 | 1/1935 | Christensen et al. . |
| 1,990,616 | 2/1935 | Rubel . |
| 2,035,365 | 3/1936 | Clayton . |
| 2,494,888 | 1/1950 | Vesconte et al. . |
| 2,678,010 | 5/1954 | Pinkvoss . |
| 2,692,568 | 10/1954 | Galkin . |
| 2,730,977 | 1/1956 | Hayes et al. . |
| 2,907,291 | 10/1959 | Schrader . |
| 3,003,443 | 10/1961 | Condran . |
| 3,425,377 | 2/1969 | Scharmer . |
| 3,726,240 | 4/1973 | Emich . |
| 3,853,078 | 12/1974 | Marforio . |
| 3,994,248 | 11/1976 | Marfurio . |
| 4,073,248 | 2/1978 | Marforio . |
| 4,152,995 | 5/1979 | Klundt . |
| 4,187,795 | 2/1980 | Norton . |
| 4,217,842 | 8/1980 | Luigi . |

(List continued on next page.)

FOREIGN PATENT DOCUMENTS

| | | |
|---|---|---|
| 312545 | 8/1928 | United Kingdom . |
| 837654 | 6/1960 | United Kingdom . |
| 1063001 | 3/1967 | United Kingdom . |
| 2204333 | 11/1988 | United Kingdom . |
| 2219604 | 12/1989 | United Kingdom . |

OTHER PUBLICATIONS

Union Special Catalog No. 95DM, Class 35800, High Speed Feed–Off–The–Arm Machines with Differential Feed.

Union Special Catalog No. 95W, Class 35700, High Speed Feed–Off–The–Arm Machines.

*Primary Examiner*—Paul C. Lewis

*Attorney, Agent, or Firm*—Brinks Hofer Gilson & Lione

[57] ABSTRACT

A fabric feed mechanism that includes a forward feed roller located forward of the stitch forming area and a rear feed roller located to the rear of the stitch forming area. The drive to the forward and rear feed rollers is synchronized such that the fabric is fed to the stitch forming instruments in a relaxed and unstretched condition. There is a independently applied downward pressure to forward and rear feed rollers and the forward feed roller is raised along with the presser foot. The front feed roller has sections that are located on opposite sides of the presser foot toe to thus ensure that the top layer of fabric is fed under the presser foot rather than riding up the front roller. A material folding device is located forward of the stitch forming area for folding material to be fed to the stitch forming area. An adjustable edge guide member is mounted on the bracket for the forward feed roller such that the edge guide is adjacent to the forward feed roller when the forward feed roller is operative and swings forward toward the material folding device when the forward feed roller is raised where it functions as an edge guide for the material as it is being loaded into the folder and under the front feed roller. A differential feed mechanism is provided below the front roller which can be adjusted to vary the forward feed velocity of the lower ply of material relative to the upper ply which allow the machine operator to align the cross seams such that they match and control the top and bottom ply such that they come out even.

20 Claims, 15 Drawing Sheets

U.S. PATENT DOCUMENTS 4,290,376 9/1981 Brusasca et al. .
4,462,530 7/1984 Block et al. .
4,572,094 2/1986 Taddicken .
4,854,254 8/1989 Hsing .
5,090,344 2/1992 Wang .
5,331,910 7/1994 Mukai et al. .
5,493,979 2/1996 Ackermann et al. ..... 112/318

FRONT ROLLER FEEDER

CROSS-REFERENCES

The present application is a continuation in part application of application Ser. No. 08/493,849 filed Jun. 20, 1995, entitled "Front Roller Feeder" that is currently pending, now U.S. Pat. No. 5,605,106.

BACKGROUND OF THE INVENTION

The Union Special Corporation Model 35800 High Speed Feed Off-The-Arm machine is used to produce felled seams on medium to heavy weight denim. This machine is used to produce either double felled or single fell seams. The Model 35800 High Speed Feed Off-The-Arm machine has three needles and three loopers and produces three rows of Type 401 stitches. In addition to the conventional feed dogs and presser foot, this machine includes a driven upper feed roller that engages the upper surface of the fabric behind the stitch forming area and functions to pull the fabric in the direction of feed.

When using this machine to produce a double felled seam along the inseam of denim jeans or for piecing sleeves on denim jackets, a feller assembly is located forward of the stitch forming area to assist the operator in interlapping the marginal edges of the upper and lower plies of fabric.

Denim is made from large yarns and is a "twill" type fabric that easily stretches. This characteristic of denim is the reason that jeans are so comfortable to wear. However, this characteristic of denim also makes denim difficult to sew. When sewing denim fabric the fabric should be in its natural relaxed state rather than in a stretched state. If denim is sewn when it is stretched, the seam will become distorted when the fabric attempts to return to its relaxed state.

When producing inseams on denim jeans, the operator must use her or his fingers to manually push the interlaped fabric into the stitch forming area of the sewing machine. This is necessary to assure that the fabric is being stitched in its natural relaxed state and also to assure even margins along the felled seam. The production of acceptable inseams on denim jeans requires a highly skilled operator who is experienced and who has been extensively trained. When producing the inseam on denim jeans when the cross seam is encountered, the number of fabric plies abruptly quadruples. A double felled seam has four plies of material, however, when four double felled seams converge at a point, as occurs at the crouch of a pair of denim jeans, sixteen plies of material must be sewn together. Pushing the fabric into the stitch forming area when cross seams are encountered is particularly stressful on the fingers and hands of the sewing machine operator. As the cross seam approaches the stitch forming area, there is an increase in the amount of material and the balkiness of the material being advanced by the sewing machine feed mechanism. It is difficult to pull this increases amount of bulky material under and through the presser foot. As a result the forward speed of the material is slowed which causes the stitch length to be shortened. When sewing denim jeans it is usual that eight to ten stitches immediately preceding the cross seam will be shorter than standard stitch length. This is considered undesirable since not only does it effect the appearance of the garment but it further increases the bulk and stiffness of the garment in this critical area. Furthermore, if the operator must concentrate her or his attention and efforts on pushing the fabric into the stitch forming area, their attention to other facets of the operation is diminished and it becomes more likely that the fabric will not be properly fed into the feller attachment.

For the foregoing reasons, there is a need for a machine that can relieve the sewing machine operator of the manual and stressful task of pushing the folded fabric into the stitching area of the sewing machine and for the elimination of the stitch shortening that occurs immediately prior to the cross seam.

SUMMARY OF THE INVENTION

The present invention is directed to an apparatus that satisfies the need for an apparatus that will feed the fabric that has been folded to form a felled seam to the stitch forming mechanism in its natural relaxed state and to assure that the margins along the seam will be even and uniform. The apparatus consists of a sewing machine including a sewing head and a work support portion in combination with a puller feed roller disposed to the rear of the stitch forming mechanism and a synchronized driven feed roller disposed forward of the stitch forming mechanism.

The invention also consists of an upper front feed mechanism that is operatively associated with the presser foot for a sewing machine of the type that includes a lower feed mechanism that is operatively associated with the presser foot that will cooperate to feed the fabric to the stitch forming mechanism in a relaxed unstretched condition.

Another aspect of this invention consist of an apparatus including a sewing head and a work support portion in combination with a puller feed roller disposed to the rear of the stitch forming mechanism that is biased downwardly and a driven feed roller disposed forward of the stitch forming mechanism that is biased downwardly independently of the rear puller feed roller.

Still another aspect of this invention consists of a cooperative relationship between a front roller feeder and the presser foot of the sewing machine that will prevent the work product from riding up from the work surface with the front roller feeder.

Yet another aspect of this invention consists of a front roller feeder that will be raised up from the work surface along with the presser foot.

The invention further consist of a front puller mechanism that pushes the material into the sewing area that cooperates with the rear material pull mechanism which together eliminates the stitch shortening that usually occurs as the stitching approached the cross seams.

The invention also consist of the use of a differential feed mechanism that is located below the front roller to vary the forward feed velocity of the lower ply of material relative to the upper ply which allow the machine operator to align the cross seams such that they match and control the top and bottom ply such that they come out even.

One edge guide embodiment is mounted on the bracket for the forward feed roller such that the edge guide is adjacent to the forward feed roller when the forward feed roller is operative and swings forward toward the material folding device when the forward feed roller is raised where it functions-as an edge guide for the material as it is being loaded into the folder and under the front feed roller.

DETAILED DESCRIPTION OF THE PREFERRED EMBODIMENT

Figures 1, 1A:
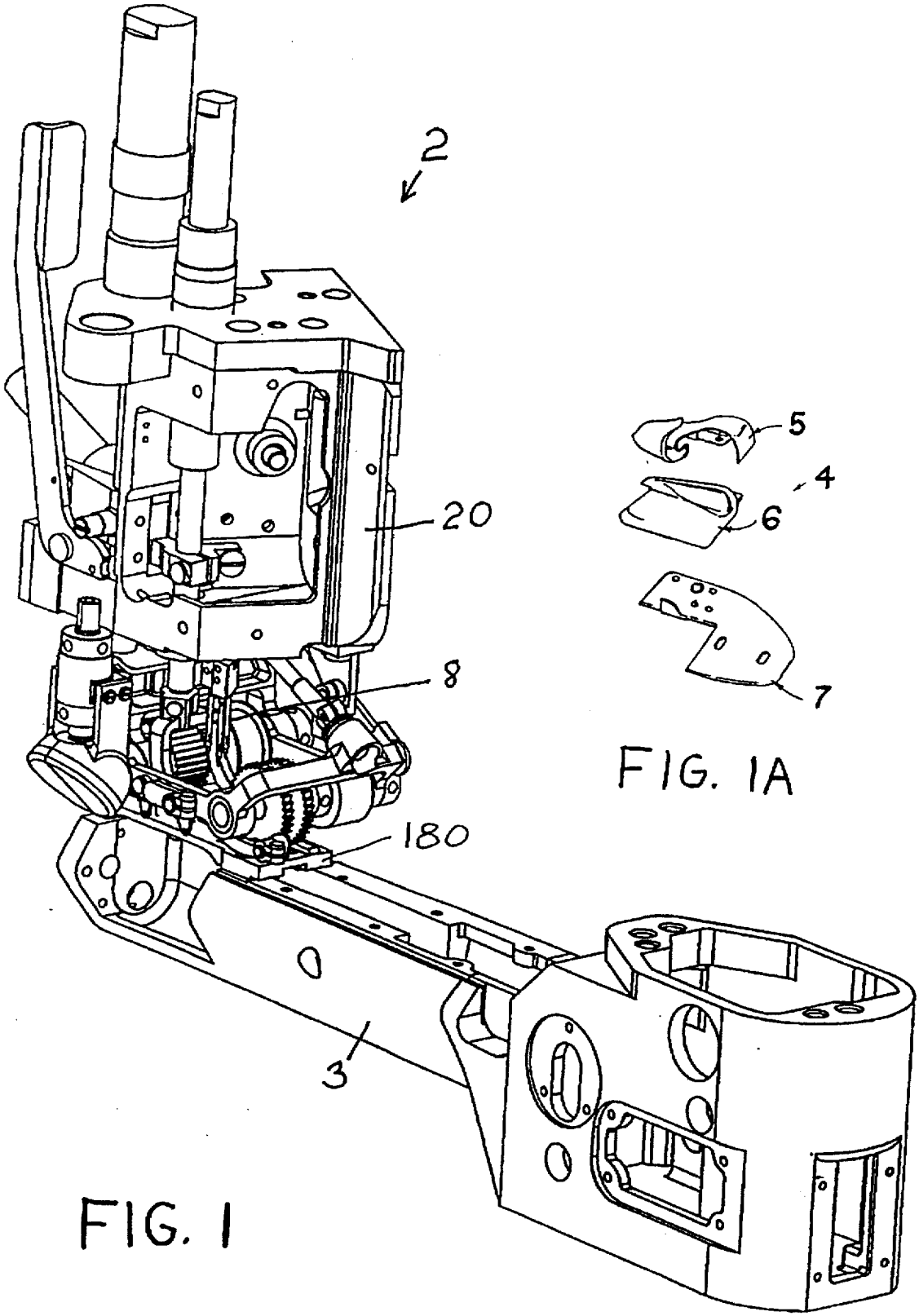
FIG. 1 is a perspective view of the upper head portion of a High Speed Feed Off-The-Arm sewing machine having an embodiment of this invention mounted thereon.
FIG. 1A is an exploded view of a feller assembly of the type that could be used with the sewing machine illustrated in FIG. 1.

FIG. 1 is a perspective view of the upper head portion 20 of a High Speed Feed Off-The-Arm sewing machine 2 including a lower arm 3 and reciprocating needles 8 that cooperate with loopers to form rows of 401 type stitches. An embodiment of the front roller feeder 30 of this invention is included in FIG. 1 to illustrate how it is mounted on the sewing machine 2.

FIG. 1A is an exploded view of a feller assembly 4 for a double felled seam of the type that could be used with the sewing machine 2 illustrated in FIG. 1. The feller assembly 4 includes an upper scroll 5, a lower scroll 6 and a base or work supporting surface 7. The assembled feller assembly 4 is mounted on the lower arm 3 of the sewing machine 2 forward of the throat plate 180.

Figure 2:
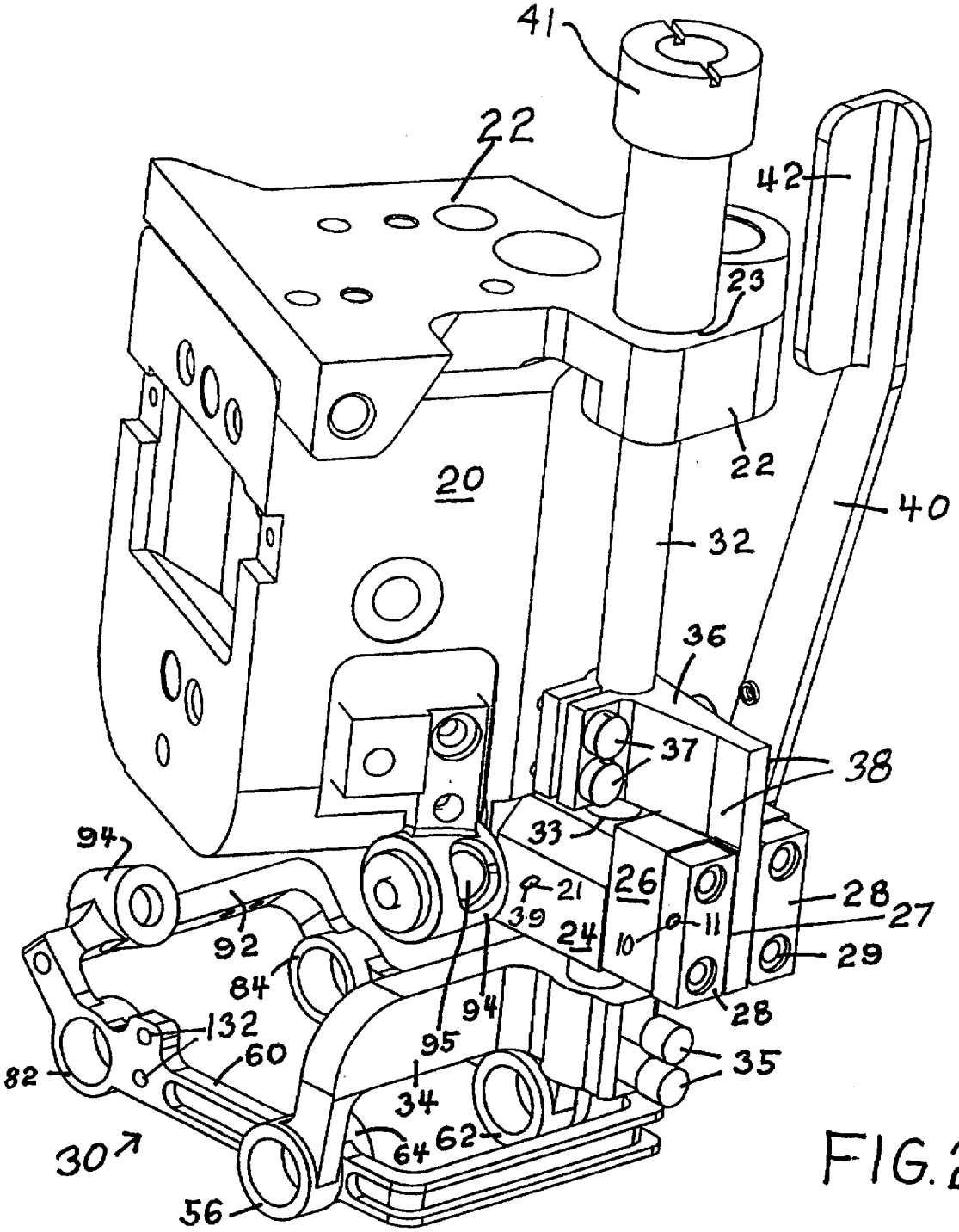
FIG. 2 is a rear perspective view of a portion of the mechanism of this invention in which the rear guidance system and rear spring pressure system mechanisms are clearly visible.

FIG. 2 is a rear perspective view of the upper head 20 and top plate 22 of the Feed Off-The-Arm sewing machine 2. An aperture 23 in the top plate 22 slidingly receives the rear shaft 32 that functions to raise and lower the main bracket 34 of the front roller feeder 30. The bottom end of rear shaft 32 is connected to the main bracket 34 by set screws 35. A rear guide finger 36, having a pair of machined guide surfaces 38 formed thereon, is secured to the rear shaft 32 by set screws 37. Down pressure is exerted on the rear guide finger 36 by a spring (not shown) that is concentric with shaft 32. The pressure exerted by the spring can be adjusted by the knob 41.

A rear guide block 24 is secured to the lower portion of the upper head 20. The bolt holes 25 for connecting the rear guide block 24 to the lower portion of the upper head 20 are visible in FIG. 15. A vertical bore 33 is formed in the rear guide block 24 that slidably receives the rear shaft 32. A horizontal bore 39 is formed in the rear guide block 24 that intersects with the vertical bore 33. An oil wick 21 is provided in the horizontal bore 39 that functions to lubricate the sliding surfaces of the rear shaft 32 and the vertical bore 33. A support block 26 is secured to the rear guide block 24 and a pair of rear guide thrust blocks 28 are secured to the support block 26 by screws 29.

The rear guide thrust blocks 28 have machined edges 27 that engage the machined guide surfaces 38 of the rear guide finger 36 to thus provide precision guidance for the front roller feeder 30 as it is raised and lowered with the rear shaft 32. The rear guide thrust block 28 can be adjusted on the support blocks 26 through the screws 29. Horizontal bores 10 are formed in the rear guide thrust blocks that communicate with the machined edges 27. An oil wick 11 is provided in each of the bores 10 to provide lubrication to the sliding machined edges 27 and guide surfaces 38. If the rear guide thrust blocks 28 become worn it is a simple and inexpensive task to replace them.

Figure 3:
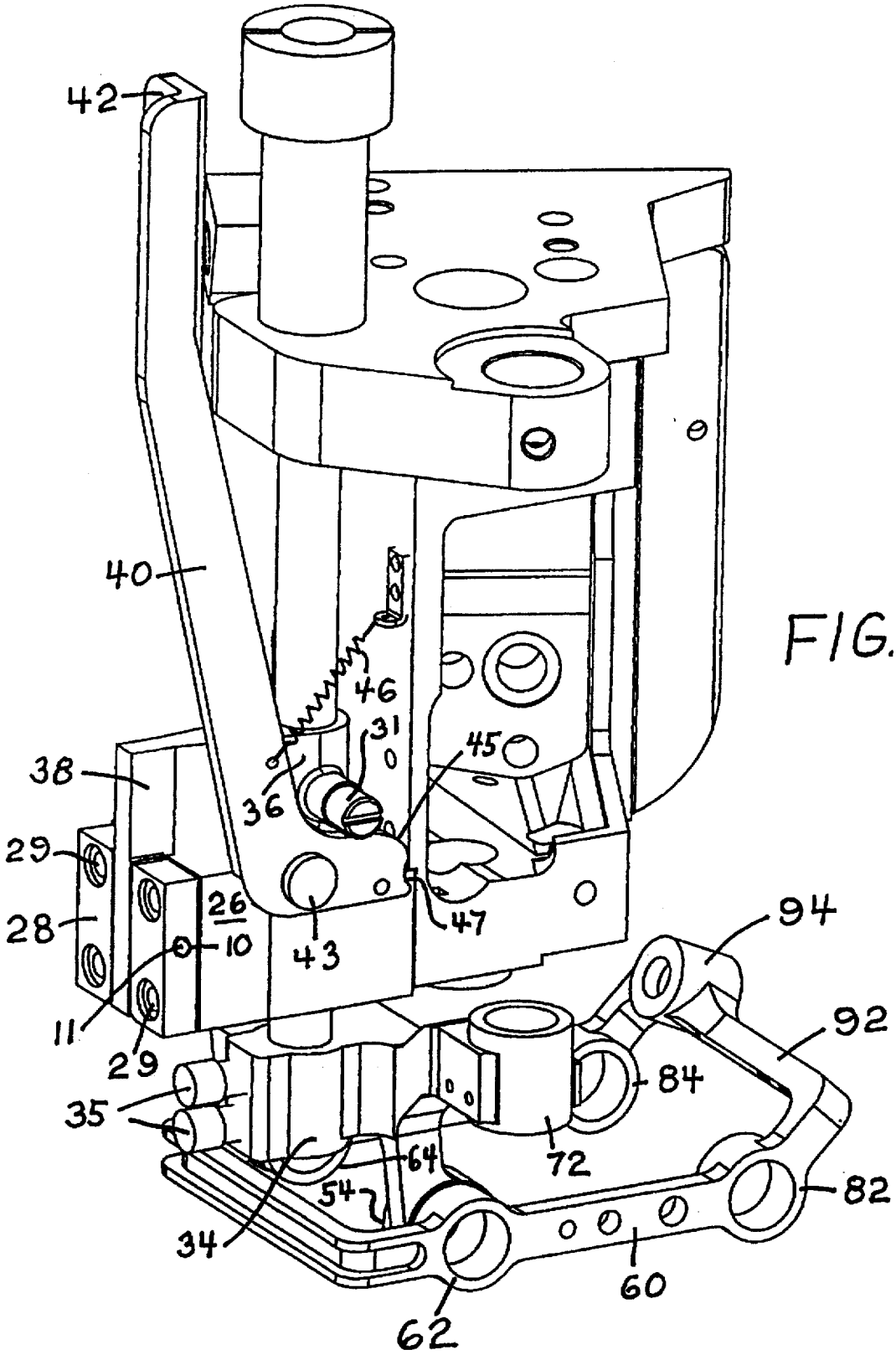
FIG. 3 is a side perspective view of a portion of the mechanism of this invention in which the manual lift for the rear shaft and the main bracket are clearly visible.
Figure 4:
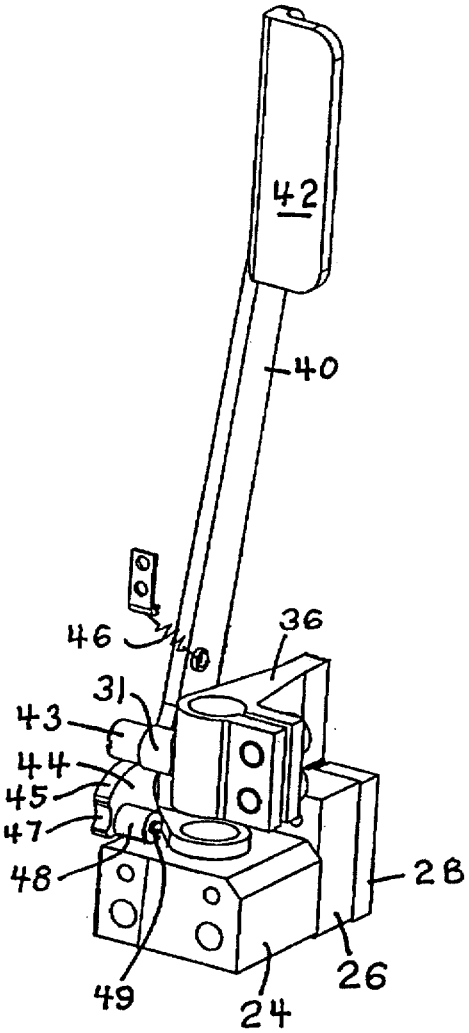
FIG. 4 is an isolated perspective view of the real lift handle for the rear shaft and the main bracket.

Referring now to FIGS. 3 and 4, a manual lift handle 40 is pivotally mounted on the rear guide block 24 by a screw 43. The lift handle 40 has a gripping portion 42 at one end and a lever 44 at the other end. The rear guide finger 36 has a lift pin 31 protruding from it that is located to be engaged by a cam surface 45 formed on the upper edge of the rear lever 44. The cam surface has a depression 47 at the end portion of the lever 44 that is shaped to receive and contain the lift pin 31 to thus support the back end of the front roller feeder 30, including the roller 50, in the full up position. The lift handle 40 is biased by spring 46 that causes the handle 40 to pivot about screw 43 in the clockwise direction as seen in FIG. 3. As best seen in FIG. 4, the lever 44 of the lift handle 40 has a stop pin 49 that carries a bumper 48. The clockwise rotation of the lift handle 40 is stopped when the bumper 48 engages the upper surface of the rear guide block 24.

During sewing operation the main bracket 34 raises and falls slightly in response to the thickness of the fabric that the rear roller 50 is encountering. Thus, there is continuous movement between the engaging surfaces 27, 38 and 32, 33 during the sewing operation. These surfaces are lubricated by the oil wicks 11 and 21 to facilitate this movement and minimize wear on the parts.

When it is desired to lift the main bracket 34 off the work piece, the operator grasps the manual lift handle 40 by the gripping portion 42 and pivots it counterclockwise against the action of spring 46. When the lift pin 31 enters the depression 47 in the lever 44 the operator can release the lift handle and the main bracket 34 will be retained in the raised position.

Figure 15:
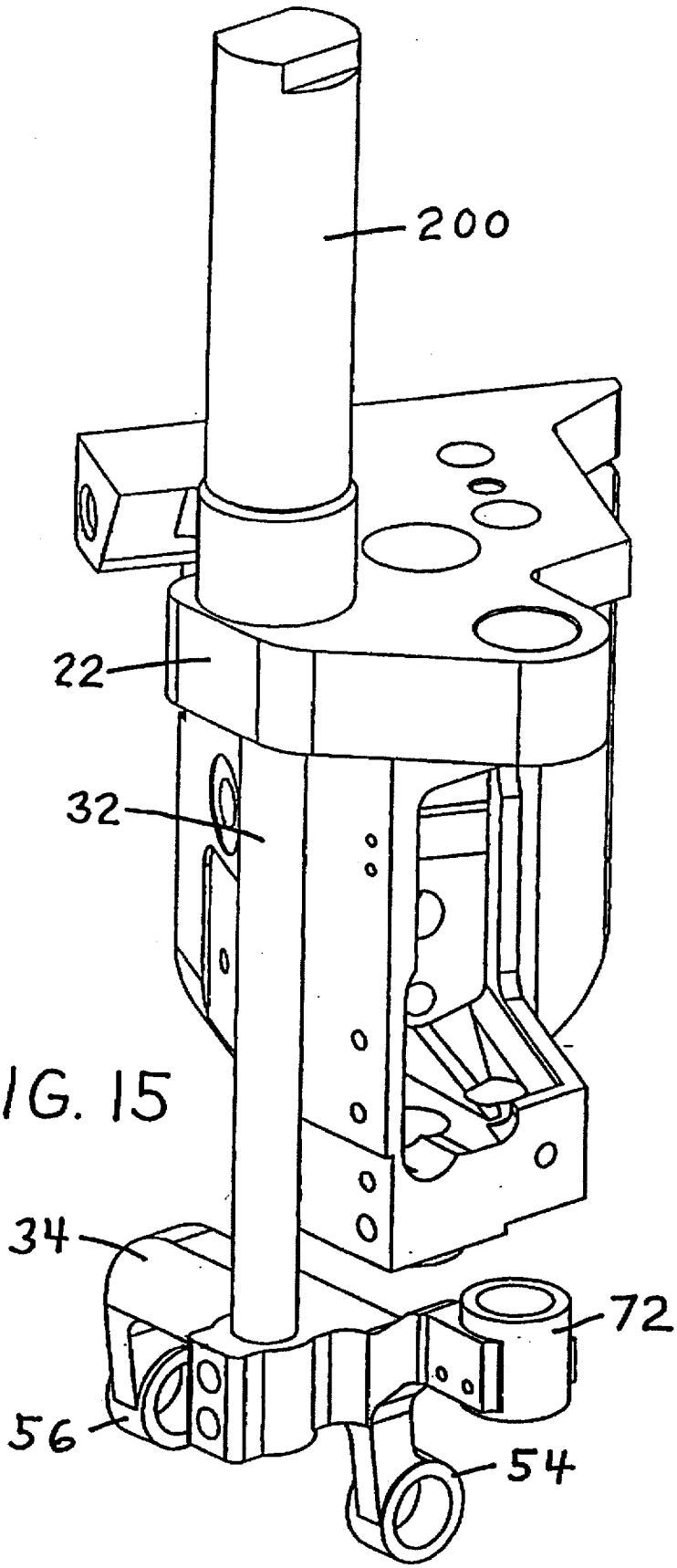
FIG. 15 is a rear perspective view of a portion of the mechanism of this invention in which the air lift mechanism for the main bracket is shown.

The rear roller 50 is secured to a rear roller shaft 52 that is journaled for rotation in the hubs 54 and 56 of the main bracket 34 (see FIG. 15). A set of needle bearings is provided in hubs 54 and 56 to minimize frictional resistance to the rotation of roller shaft 52.

Figure 6:
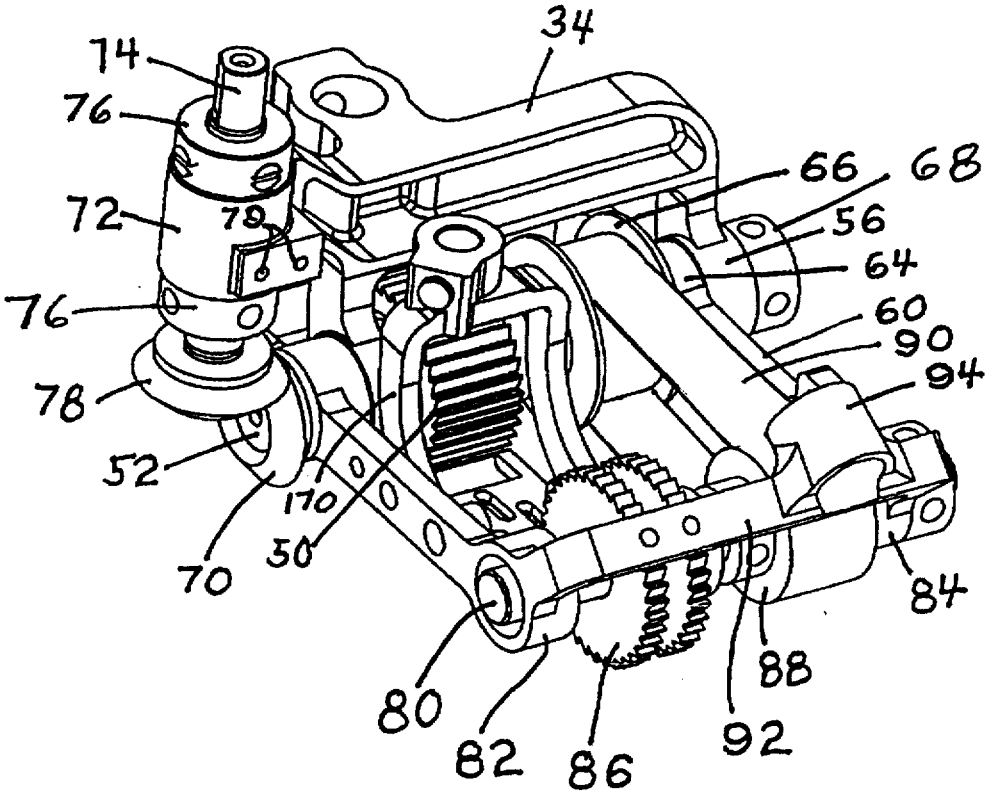
FIG. 6 is a top-front perspective view of a portion of the mechanism of this invention in which the front and rear rollers are clearly visible.

A front roller bracket 60, having a generally rectangular shape, includes hubs 62 and 64 that are journaled on the rear roller shaft 52. Hubs 62 and 64 are integral with the front roller bracket 60. A rear pulley 66, see FIG. 6, is secured to rear roller shaft 52 between the rear roller 50 and the hub 64. A thrust collar 68 is secured to one end of the roller shaft 52 and a driven miter gear 70 to its other end.

A vertically orientated hub 72 is carried by the main bracket 34 for journaling a drive shaft 74. A set of needle bearings is carried by the hub 72 for minimizing the friction in this journal. Thrust collars 76 are provided to maintain the drive shaft 74 in the hub 72. A drive miter gear 78 is carried by the lower end of drive shaft 74. Drive miter gear 78 meshes with the driven miter gear 70 and transmits rotary motion to roller shaft 52.

Figure 10:
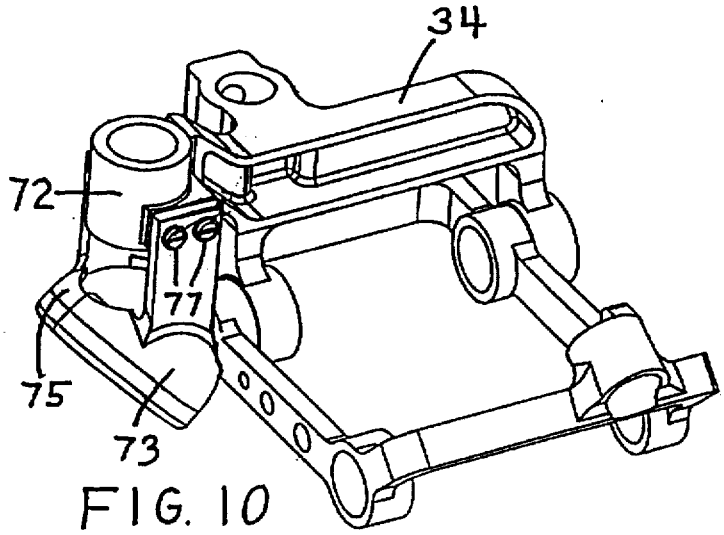
FIG. 10 is a front perspective view of a portion of the mechanism of this invention in which the miter gear case for the rear roller drive is clearly visible.

As seen in FIG. 10, a front cover 73 and a rear cover 75 are provided for the miter gears 70 and 78. The covers 73 and 75 are secured to the main bracket 34 by screws 77 that are threaded into threaded bores 79 in the main bracket 34. The preferred embodiment includes a one piece plastic cover for the miter gears 70 and 78.

The front roller bracket 60 (see FIG. 6 and 6A) includes a pair of hubs 82 and 84 at its forward end in which is journaled a front roller shaft 80. The hubs 82 and 84 have sets of needle bearings to minimize friction in these journals. A front roller 86 and a front pulley 88 are secured to front roller shaft 80 for rotation therewith. The front pulley 88 is aligned with rear pulley 66 and a drive belt 90 extends over the aligned pulleys 88 and 66 such that the rotary motion of rear roller shaft 52 is transferred to the front roller shaft 80. In the preferred embodiment the pulleys 66, 88 and the belt 90 are of the sprocket type that have grooves and ridges on their engaging surfaces. This sprocket type drive not only provides a more positive drive connection between the pulleys and the belt, but also ensures that the front roller 86 and rear roller 50 are synchronized.

Figure 8:
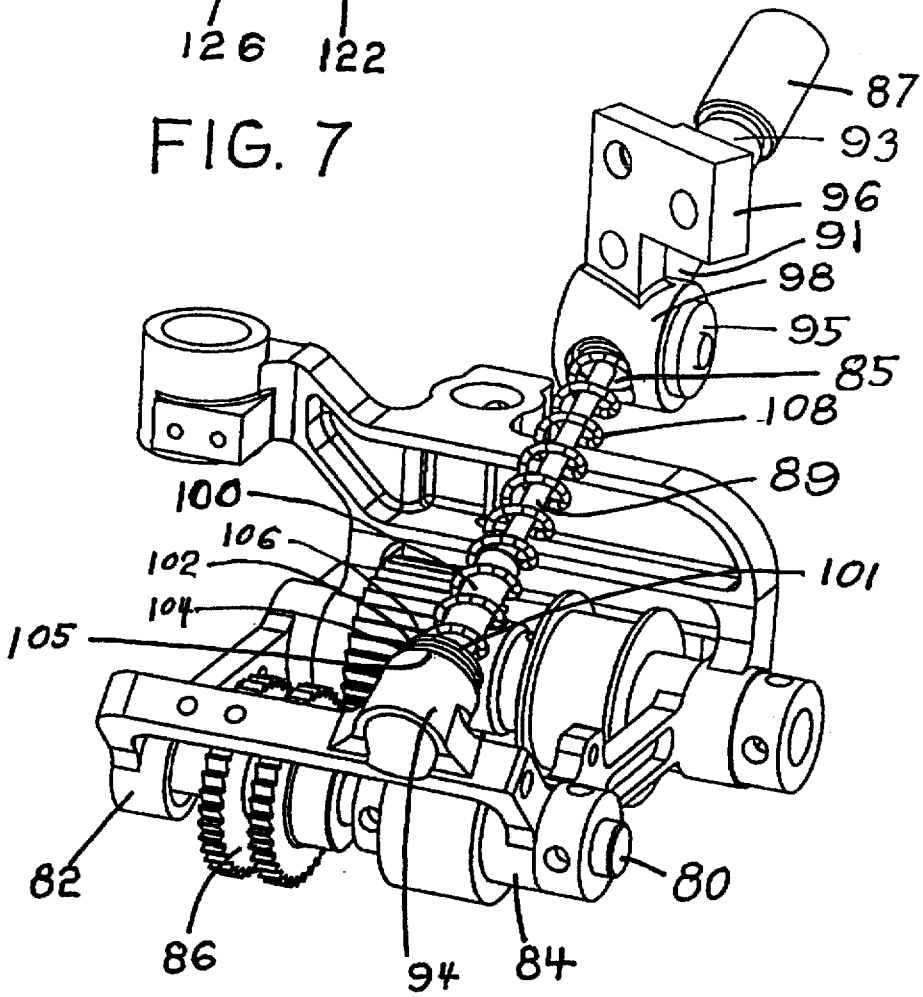
FIG. 8 is a front perspective view of a portion of the mechanism of this invention in which the manual spring for the front roller is clearly visible.

The front roller bracket 60 has an inclined U-shaped portion 92, that includes a hub 94, at its forward end. As best seen in FIGS. 2 and 8 a hub 98 having a bracket 96 that has three holes 97 formed therein is mounted by bolts (not shown) in three bolt holes (not shown) that are formed in the upper head 20. As best seen in FIG. 2 an internally threaded spring pivot bushing 95 is housed in the hub 94. An elongated compression rod 93 (see FIG. 8) having a knurled knob 87 and a threaded portion 91 is threaded through the internally threaded spring pivot bushing 95. The compression rod 93 includes a guide rod portion 89 that is of smaller diameter than the threaded portion 91. A shoulder 85 is formed on the compression rod 93 at the intersection of the threaded portion 91 and the guide rod portion 89 that functions as a thrust surface for a spring 108. A hollow guide tube 100 slidingly receives the lower end of the guide rod 89. The lower end of the hollow guide tube 100 extends into the hub 94. A thrust washer 102 with an underlaying neoprene washer 104 are received over the hollow guide tube and engage a shoulder 105 formed by the upper annular edge of the hub 94. An annular groove 101 is formed in the hollow guide tube that receives a crescent ring 106 that functions to retain the thrust washer 102 and underlaying neoprene washer 104 in place. The lower end of the spring 108 engages the thrust washer 102 to thus provide an adjustable downward pressure on the forward portion of the front roller bracket 60.

The operator can adjust the tension on spring 108 by grasping the knurled knob 87 of the compression rod 93 and turning it one way or the other. When the compression rod 93 is rotated it is threaded up or down through the internally threaded spring pivot bushing which causes the shoulder 85 of the compression rod 93 to move toward or away from the shoulder 105 of the hub 94. This causes the spring 108 to compress or expand and adjusts the downward pressure on the front roller bracket 60. The spring pivot bushing 95 can oscillate about its axis within the hub 98 which is necessary to accommodate vertical movement of the front roller 86, for example, when the front roller encounters and rides up on a cross seam. This allows the front roller 86 to elevate and walk over the cross seam when it is encountered while continuing to provide positive feed to the work material. This positive pushing of the work material has eliminated the undesirable stitch shortening, that occurs in the eight to ten stitches before going over the cross seam, in the prior art machines. In this situation if the spring pivot bushing 95 was stationary and could not rotate about its axis the system would likely bind.

Figure 7:
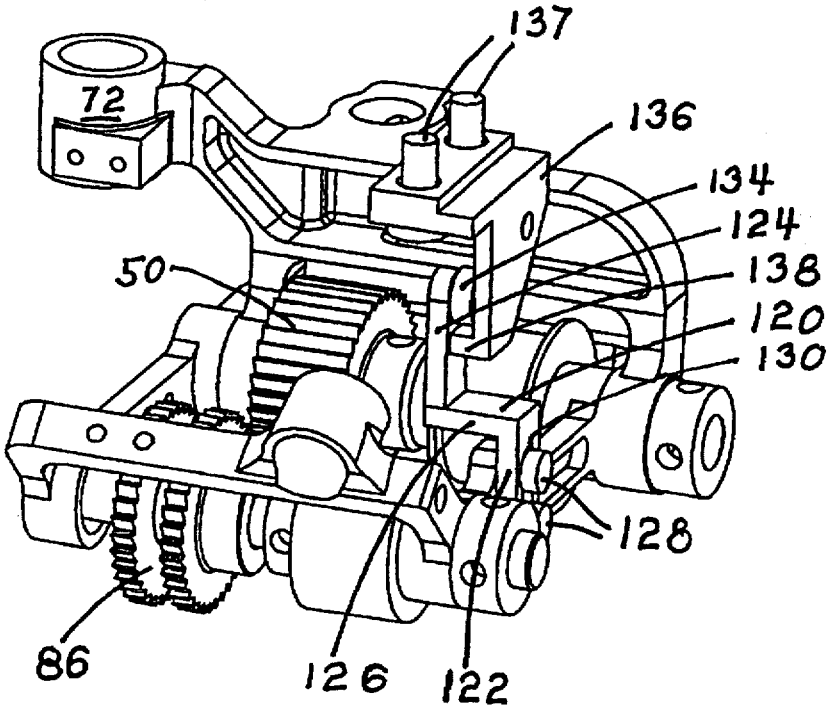
FIG. 7 is a front perspective view of a portion of the mechanism of this invention in which the height adjusting brackets are clearly visible.

There is illustrated in FIG. 7 the height adjustment mechanism for the front roller feed. A first height adjustment bracket 120 having a first vertically extending leg 122, a second vertically extending leg 124 and a connecting horizontal section 126 is secured to the front roller bracket by screws 128. A vertically extending slot 130 is formed in the first vertically extending leg 122. The screws 128 extend through slot 130 and are threaded into threaded bores 132 (see FIG. 2) formed in the front roller bracket 60. A nylon bumper 134 is secured to the upper portion of the second vertically extending leg 124. The slot 130 permits the height adjustment bracket 120 to be secured to the front roller bracket 60 within an adjustment range such that the distance between the nylon bumper 134 and the front roller bracket 60 can be varied depending upon conditions. A second height adjustment bracket 136 is secured to the upper head 20 in the general area above the location of the first height adjustment bracket 120 by screws 137. The second height adjustment bracket 136 includes a tab 138 having a horizontal upper surface that underlies the nylon bumper 134. When the nylon bumper 134 engages the horizontal upper surface of the tab 138, downward movement of the front roller bracket 60 is stopped. The position where downward movement of the front roller bracket 60 is stopped can be adjusted through the slot 130 and screws 128.

Figure 9:
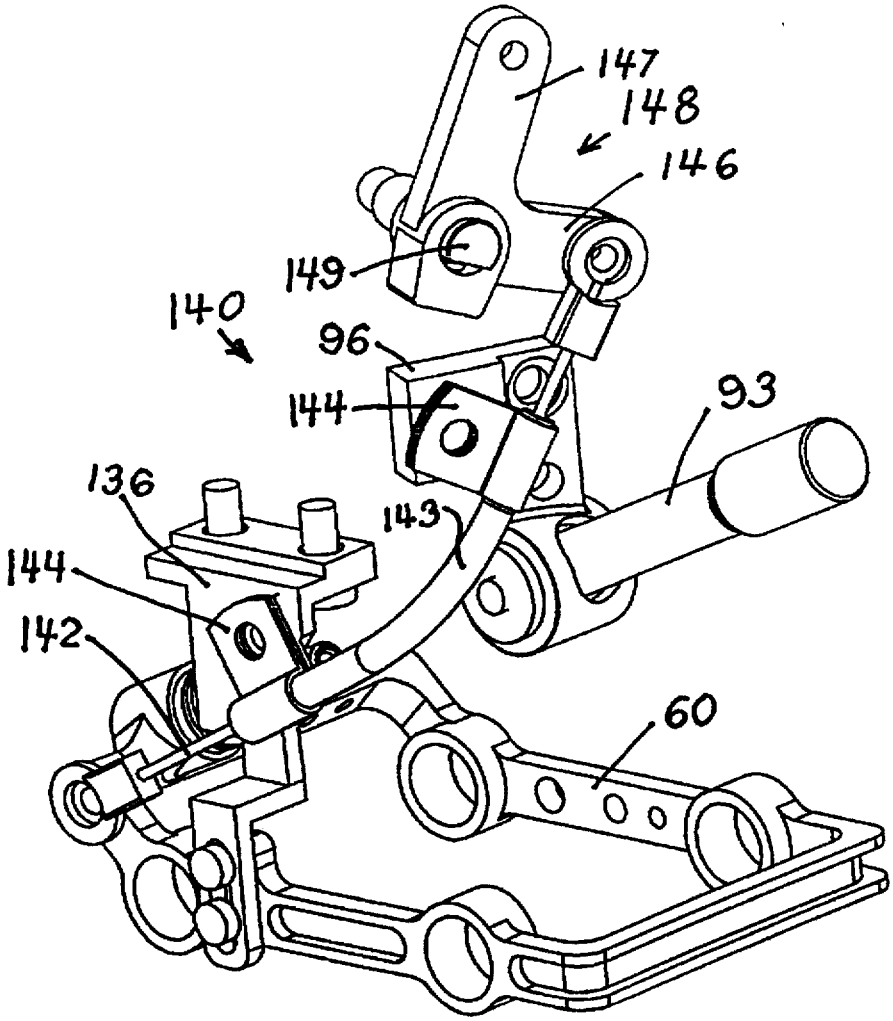
FIG. 9 is a rear perspective view of a portion of the mechanism of this invention in which the manual lift cable assembly is clearly visible.

There is shown in FIG. 9 the manual lift cable assembly 140 for the front roller feed. The manual lift cable assembly 140 includes a flexible cable 142 contained in a case or shield 143 of the Bowden conduit type. The shield 143 is secured to the head 20 of the sewing machine by mounting clips 144. The upper mounting clip 144 is secured to the head 20 by one of the bolts that secure the spring pivot bracket 96 to the head 20. The lower clip 144 is secured by a screw (not shown) to the second height adjustment bracket 136. The upper end of the flexible cable 142 is connected to an arm 146 of a the lift lever bell crank 148 that is secured to and pivots with pivot rod 149. The pivot rod 149 is journaled in an opening 163 formed in the head 20. The other arm 147 of the lever 148 is connected in a conventional manner to the presser bar lift mechanism. The lower end of the flexible cable 142 is connected to the U-shaped portion 92 of the front roller bracket 60. Thus, when the presser bar lift mechanism is engaged to, for example, raise the presser bar 160, a corresponding movement is transmitted to the forward end of the front roller bracket through the flexible cable 142 and the front roller 86 to be lifted off the work product. When the presser bar 160 is lowered, the lever 148 is pivoted in the opposite direction which allows the front end of the front roller bracket 60 to descend until the nylon bumper 134 encounters the tab 138 which stops its downward movement at the preselected elevation.

Figure 5:
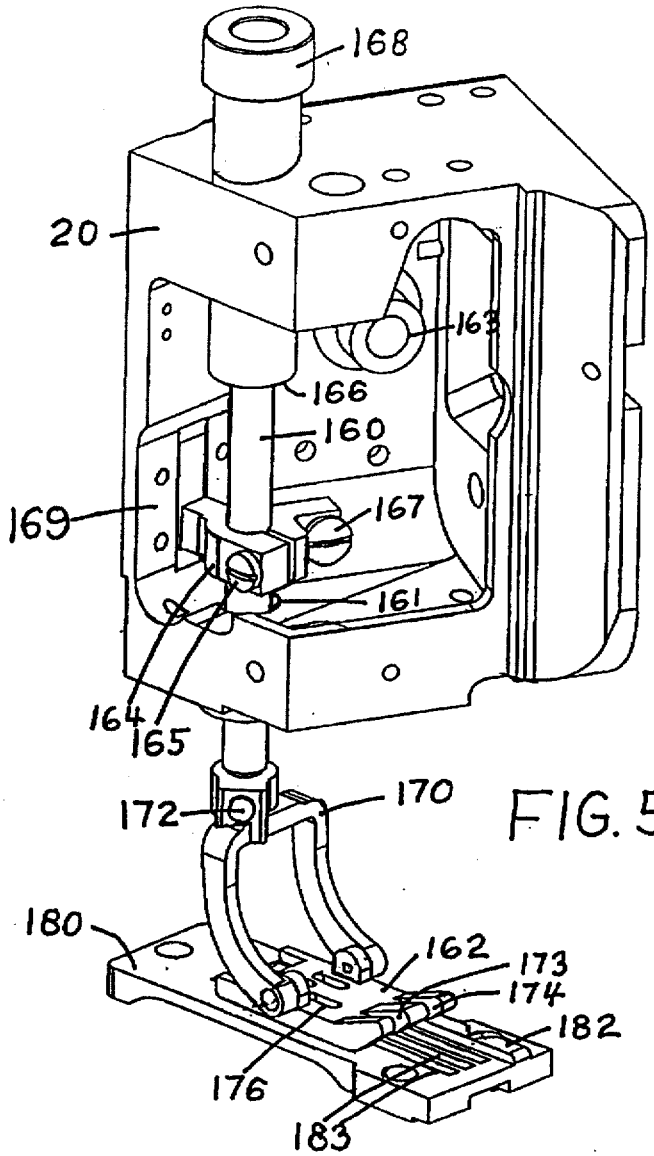
FIG. 5 is a front perspective view of a portion of the mechanism of this invention in which the presser foot bar, presser foot holder, presser foot and throat plate are clearly visible.

The presser bar 160 and presser foot 162 are illustrated in FIG. 5. The presser bar 160 is a conventional presser bar that is mounted for vertical reciprocating movement in the head 20 by bushings such as bushing 161. A presser bar lift and guide 164 is secured to the presser bar by a screw 165. A presser spring (not shown) engages the upper surface of the lift and guide 164 and a shoulder 166 to thus exert a downward pressure on the presser foot 162. A knurled knob 168 can be turned by the operator to vary the intensity of the spring pressure. Adjustable guide plates 169 are provided that cooperate with the presser bar lift and guide 169 to insure smooth reciprocal movement of the presser bar 160. As is well known in the sewing machine art, one end of a lift link (not shown) is linked to the lift and guide 164 by screw 167 and the other end of the lift link is linked to the presser bar lift lever that is carried by a pivot rod 149 that is journaled in opening 163. The lift lever bell crank 148 is secured to the other end of pivot rod 149. A presser foot holder 170 is secured to the lower end of the presser bar 160 by a set screw 172. The presser foot holder is in the form of a two tine fork that is pivotally connected to the presser foot 162 at the extremities of the tines. The presser foot 162 includes three upwardly inclined toe sections that are separated by slots 173 and 174. The presser foot 162 also has needle opening 176 formed therein. The presser foot 162 is biased downwardly toward the throat plate 180. The throat plate 180 includes a raised ridge 182 that extends in the direction of stitch formation and a plurality of slots 183 through which the feed dog elements project.

Figure 6A:
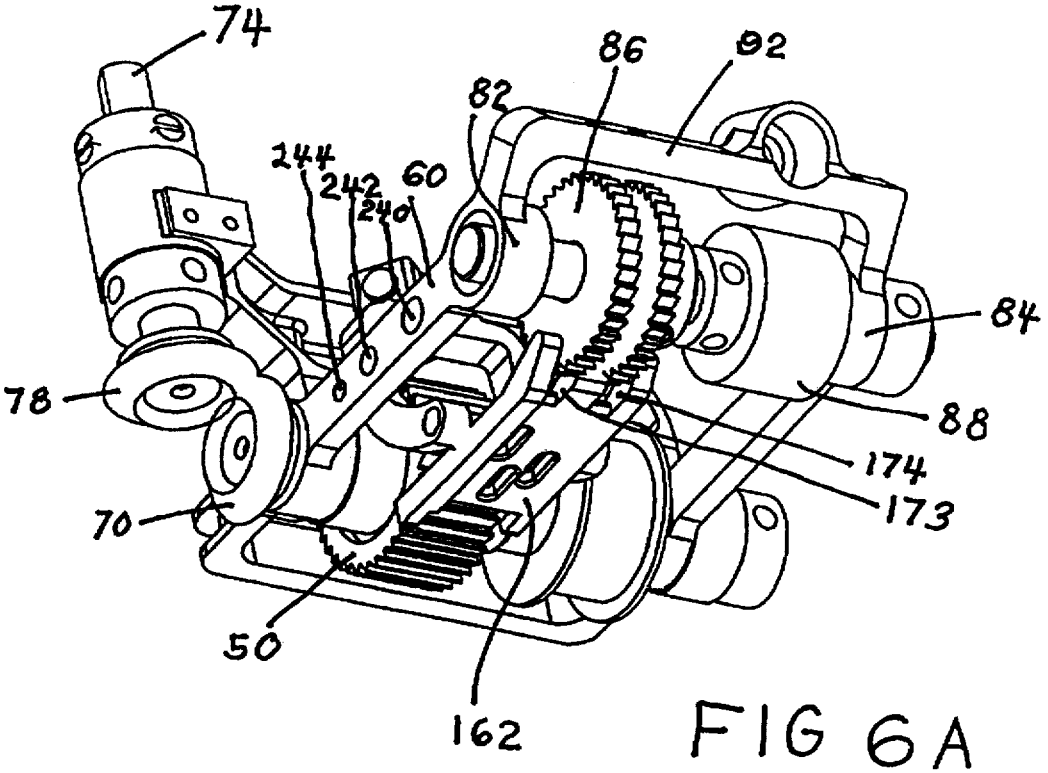
FIG. 6A is a bottom-front perspective view of a portion of the mechanism seen in FIG. 6, with the drive belt removed.
Figure 11:
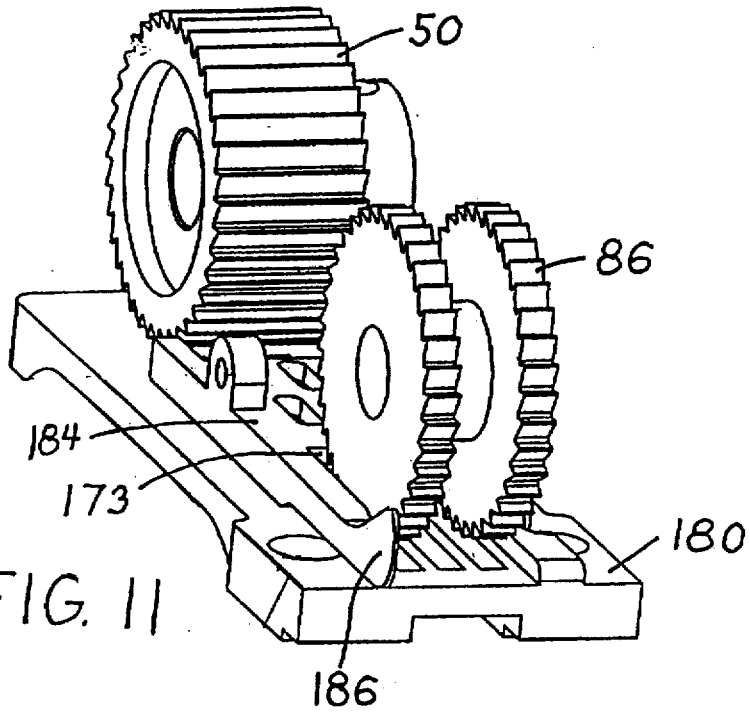
FIG. 11 is a front perspective view of a portion of the mechanism of this invention in which the throat plate, presser foot, rear roller and front roller are clearly visible.

There is shown in FIG. 11 another embodiment of a presser foot, designated 184, that includes an integral edge guide 186 that functions to guide the folded edge of the top ply of material. Edge guide 186 will ensure that the margin of material between the edge and the adjacent row of stitches remains uniform. This embodiment of the presser foot will produce a stitch with a fixed width margin of material between the folded edge of the top ply and the row of stitches. The presser foot must be replaced with a different presser foot, having the edge guide 186 at a different location relative to the needle holes, if a stitch having a margin of a different width is desired. In FIG. 11 the rear roller 50 and front roller 86 have been included to illustrated their relationship to the presser foot. It should be noted that, in the embodiment of the presser foot 162 shown in FIG. 5 as well as the embodiment of the presser foot 184 shown in FIG. 11, the two sections of front roller 86 are located within the slots 173 and 174 formed in the presser foot and one of the presser foot toes is located between the sections of the front roller 86. This relationship is best illustrated in FIG. 6A which is a bottom view of the presser foot 162. This is an important relationship of this invention since the top ply of material has a tendency to stick to the front roller 86 and ride up with it. The presence of the presser foot toe between the sections of the front roller 86 functions to strip the top ply of the work product off the front roller and cause it to feed under the presser foot as desired. FIG. 6A also illustrates that the rear roller 50 is in a position relative to the presser foot 162 to exercise control over the work product as soon as control is lost by the presser foot.

Figure 12:
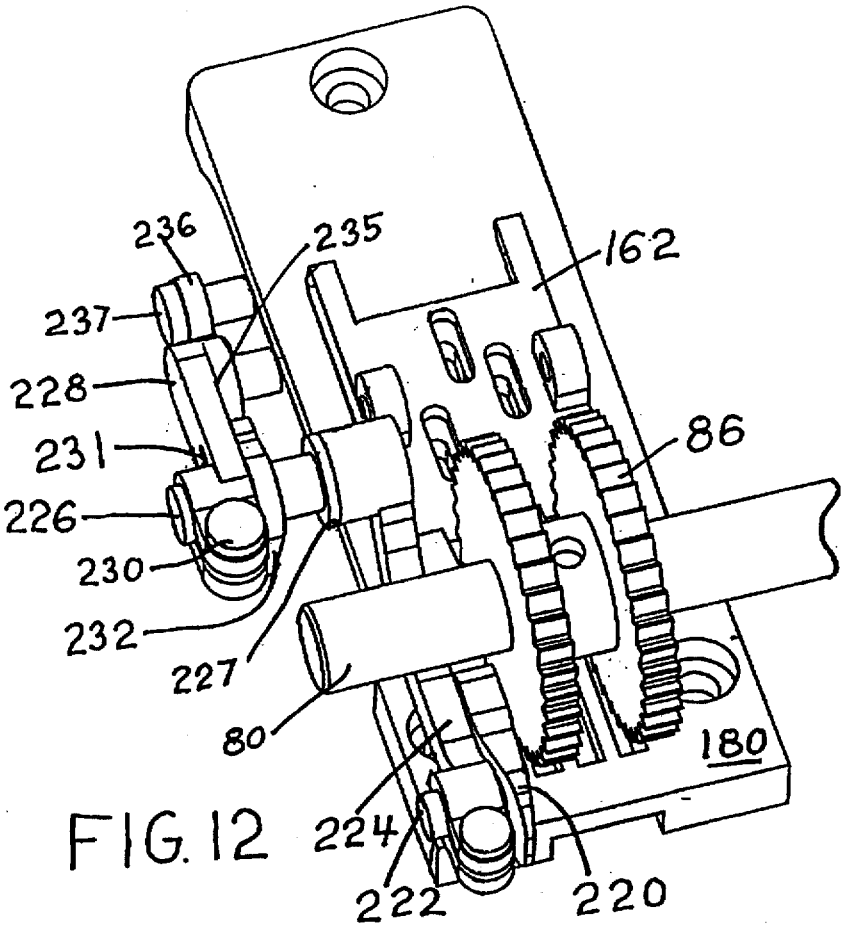
FIG. 12 is a top perspective view of a portion of the mechanism of this invention including the adjustable edge guide embodiment.
Figure 13:
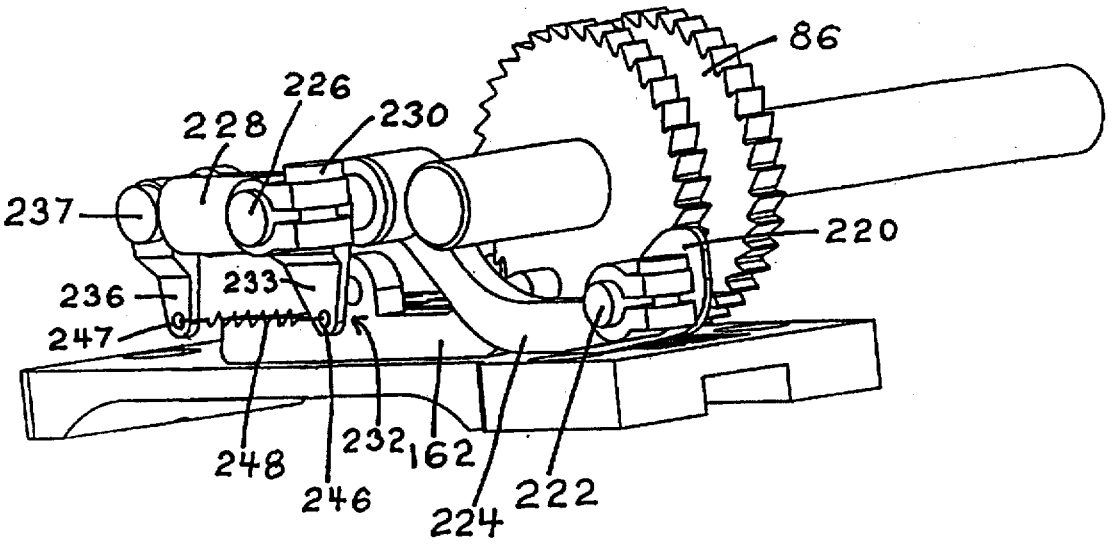
FIG. 13 is a front perspective view of a portion of the mechanism of this invention including the adjustable edge guide embodiment.
Figure 14:
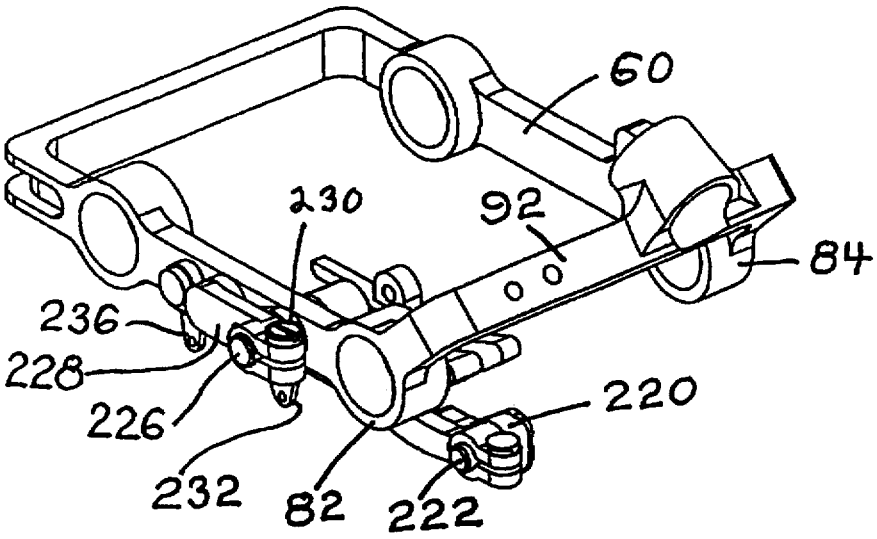
FIG. 14 is a front perspective view of a portion of the mechanism of this invention including the front roller bracket and the adjustable edge guide embodiment.

FIGS. 12, 13 and 14 disclose an embodiment in which the edge guide 220 for the top ply of work product is adjustable laterally so that the margin of material between the folded edge and the row of stitches can be varied without the need to replace the presser foot. The adjustable edge guide 220 is adjustable left to right relative to the line of stitching to vary the width of the margin between the folded edge of the upper ply of material and the row of stitches. The mounting mechanism that carries the adjustable edge guide 220 is mounted in holes 240, 242 and 244 (see FIG. 6A) formed in the front roller bracket 60. Through its mounting mechanism the adjustable edge guide 220 is independently spring loaded so that it can contact the work material and rise up and down as it crosses over seams.

The edge guide 220 has an integral edge guide mounting pin 222 that extends into an opening 223, formed in the guide arm 224. The edge guide mounting pin 222 can slide longitudinally of its axis in opening 223 and can be locked in a longitudinal adjusted position by a screw 225. This longitudinal adjustment and locking in a selected location allows the edge guide 220 to be adjusted left or right of the row of stitches and thus to establish the width of the margin. This adjustable feature allows the margin to be varied without replacing the presser foot 162. The guide arm 224 has a pivot shaft 226 at its rear end that extends through hole 240 that is formed in the front roller bracket 60 (see FIG. 6A). A washer 227 is carried by pivot shaft 226 for engagement with the surface of the front roller bracket 60 to provide free pivot movement. The pivot shaft 226 allows the edge guide 220 to pivot up and down as is required for it to cross over seams and the like. A front spring finger 232 is carried by the portion of the pivot shaft 226 that projects out of hole 240 on a aperture (not shown) formed in the front spring finger 232. The front spring finger 232 includes a downwardly directed arm 233 and a check pin 231 that extends parallel to pivot shaft 226. A hole 246 is formed at the lower extremity of the downwardly directed arm 233 for receiving one end of a spring 248. An edge guide thruster 228 is carried by the pivot shaft outwardly of the front spring finger 232. The edge guide thruster 228 includes an arm 229 that has an aperture formed therein for reception of the check pin 231 of the front spring finger 232. The edge guide thruster 228 is secured to the pivot shaft 226 by a screw 230.

Thus, the downwardly directed arm 233 of the front spring finger 232 and the arm 229 of the edge guide thruster 228 are fixed to the pivot shaft 226 and pivot therewith. A thrust pin 234 made, for example, of nylon material, having a flat head 235 is carried by hole 242 formed in the front roller bracket 60. The arm 229 of the edge guide thruster 228 is flush with and slides along the flat head 235 of the thrust pin 234. A rear spring finger 236 is secured in the threaded hole 244 formed in the front roller bracket 60 by a screw 237. An opening 247 is formed at the extremity of the rear spring finger 236 for the reception of the other end of spring 248. Spring 248 extends from the rear spring finger 236 to the front spring finger 232 and functions to exert a clockwise torque on pivot shaft 226 and thus, a downward spring pressure on the edge guide 220. The magnitude of this downward spring pressure can be adjusted by adjusting the location of rear spring finger 236 by loosening screw 237 adjusting the location of the rear spring finger 236 and securing it in adjusted position by the screw 237.

FIG. 15 discloses the preferred embodiment for controlling the rear shaft 32. In this embodiment a double acting air cylinder 200 is connected to the upper end of shaft 32 above the top plate 22. Pressurized air can be supplied to either side of the piston of air cylinder 200. When air under pressure is supplied to cylinder 200 causing a downward pressure to be applied to the main bracket 34, a spring that performs that task in the manual embodiment is eliminated. When air under pressure is supplied to cylinder 200 causing the main bracket to be lifted up off the work product, the manual lift handle 40 has been eliminated. The sewing machine operator can control the pressurized air that is directed to double acting air cylinder 200.

Figure 16:
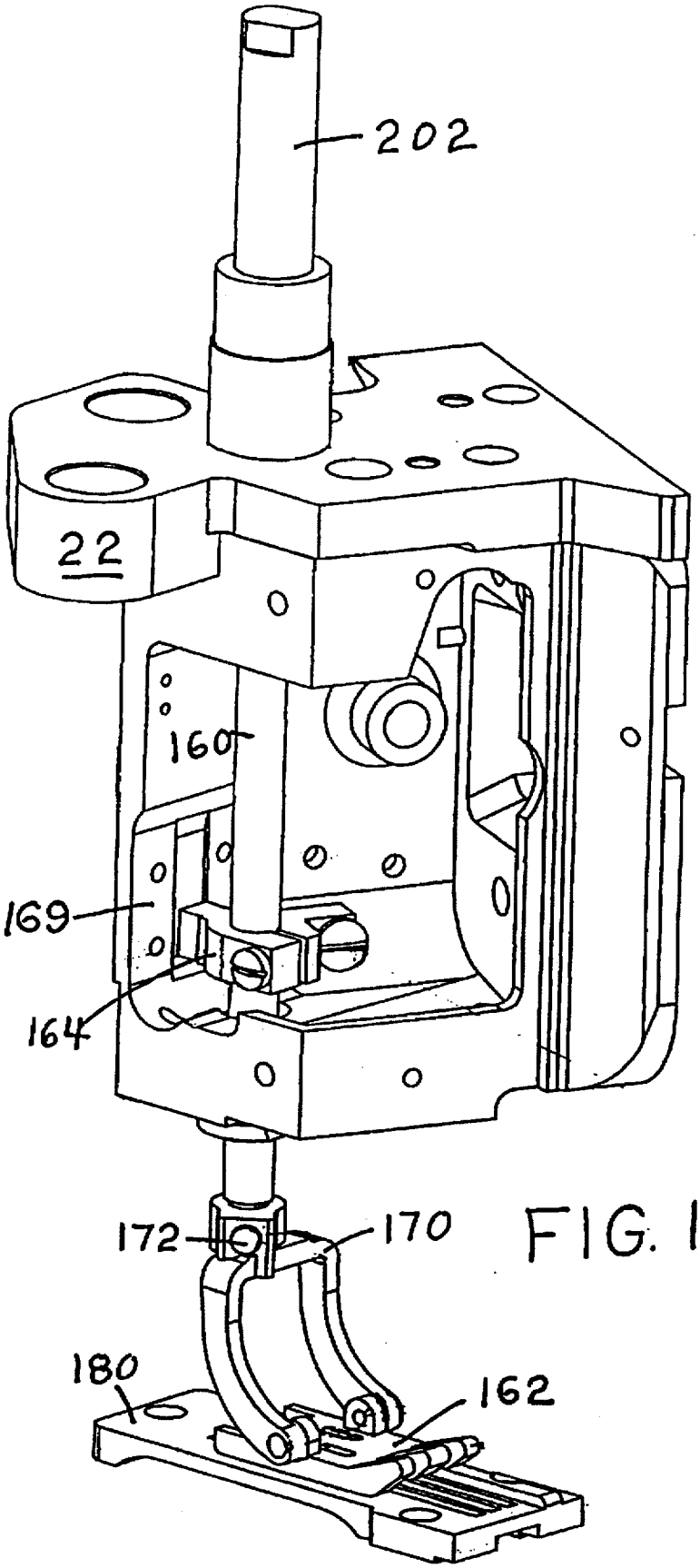
FIG. 16 is a front perspective view of a portion of the mechanism of this invention in which the presser foot bar, presser foot holder, presser foot, throat plate and the presser bar air lift mechanism are clearly visible.

FIG. 16 discloses the preferred embodiment for raising and lowering the presser bar 160. A double acting air cylinder 202 is connected to the top of the presser bar 160 above the top plate 22. Air cylinder 202 is energized in one direction to raise the presser bar 160 and in the other direction to lower it. The sewing machine operator can control the pressurized air that is directed to double acting air cylinder 202.

Figure 17:
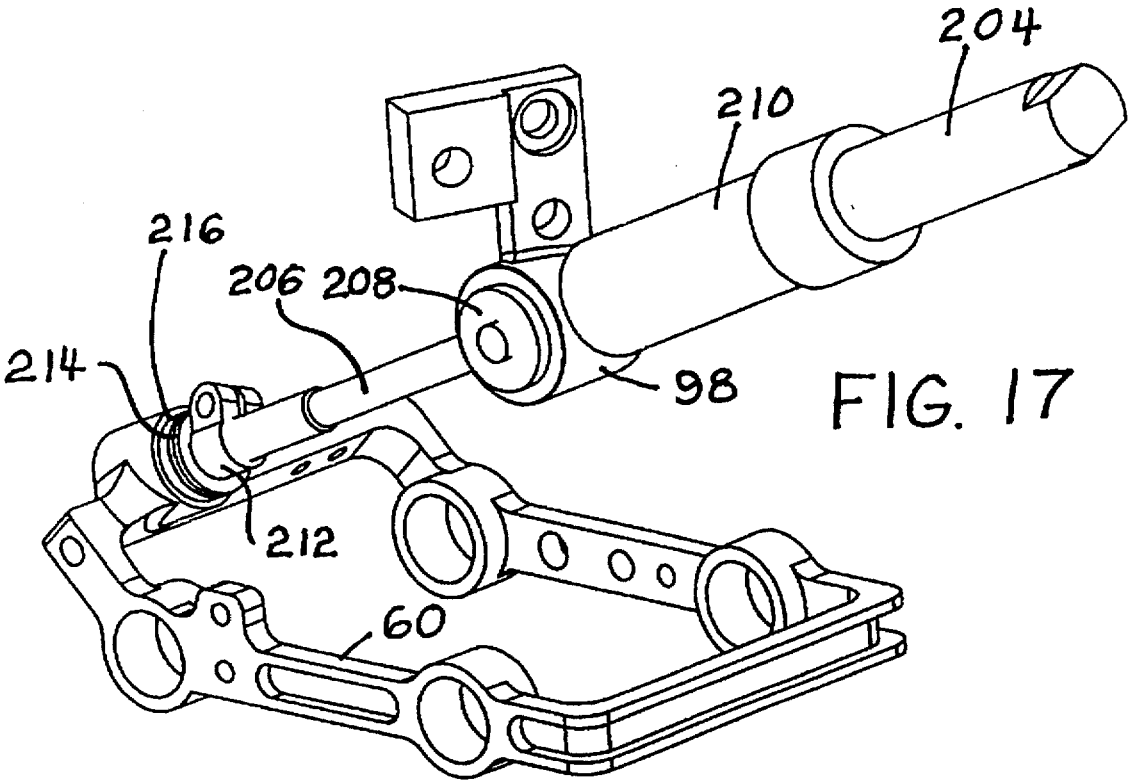
FIG. 17 is a rear perspective view of a portion of the mechanism of this invention in which the front air pressure lift mechanism is clearly visible.

FIG. 17 discloses the preferred embodiment for raising the front end of the front roller bracket 60 and the front roller 86. In this embodiment a double acting air cylinder 204 is connected to front air shaft 206. As in the mechanical embodiment that is illustrated in FIG. 8 a pivot bushing 208 is journaled for oscillating motion in the hub 98. The front air shaft 206 extends through a bore formed in the pivot bushing 208 into front air adapter 210. Within the front air adapter 210, the front air shaft 206 is coupled to the piston rod (not shown) of the double acting air cylinder 204. A clamp 212, thrust washer 214 and a neoprene washer 216 are provided at the lower end of the front air shaft 206 to transfer the reciprocating motion of the front air shaft 206 to the U-shaped portion 92 of the front roller bracket 60. In the mechanical embodiment, (see FIG. 8) the front roller spring 108 functions to provide an adjustable pressure in the downward direction on the front roller bracket 60. This function is replaced in the preferred air cylinder embodiment by air cylinder 204. However, in the preferred air cylinder embodiment, the air cylinder 204 also performs the function of raising and lowering the front end of the front roller bracket 60. That function in the mechanical embodiment is performed by the manual lift cable assembly 140 that is illustrated in FIG. 9. The sewing machine operator can control the pressurized air that is directed to double acting air cylinder 204.

Figure 19:
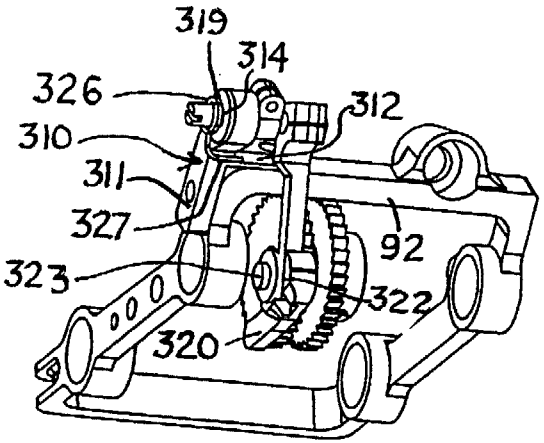
FIG. 19 is an isolated perspective view of the edge guide embodiment illustrated in FIG. 18 shown in the operative position adjacent to the front feeder roller.
Figure 21:
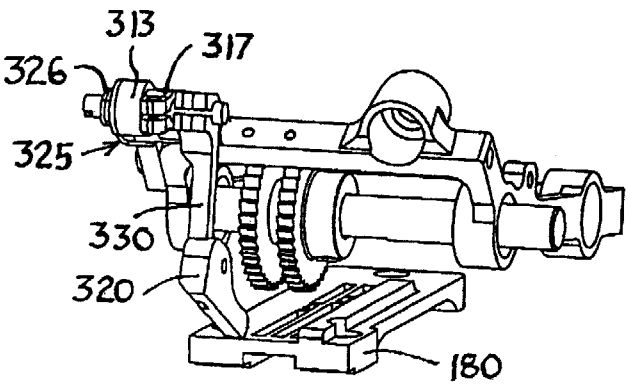
FIG. 21 is an isolated perspective view of the edge guide embodiment illustrated in FIGS. 18–20 shown with the front roller bracket raised and the edge guide swung forward.
Figure 18:
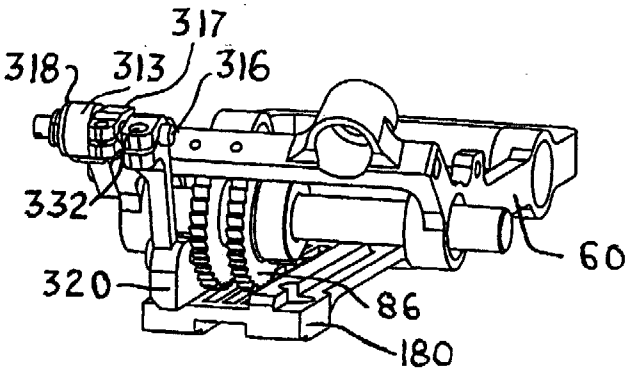
FIG. 18 is an isolated perspective view from above of another edge guide embodiment that is shown in the operative position adjacent to the front feeder roller and the threat plate.
Figure 20:
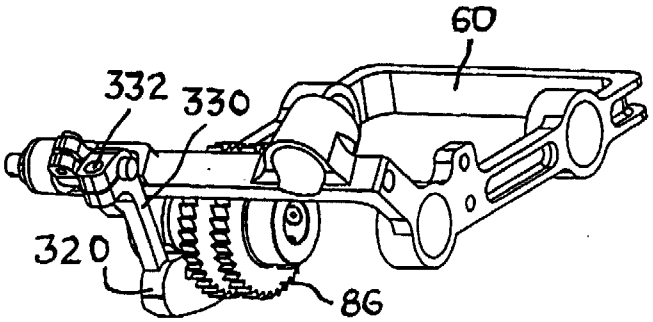
FIG. 20 is an isolated perspective view of the edge guide embodiment illustrated in FIGS. 18–19 shown in the operative position adjacent to the front feeder roller without the throat plate.

An additional edge guide embodiment is illustrated in FIGS. 18 through 21. As best seen in FIG. 19 an edge guide bracket 310 is secured to the left edge of the inclined U-shaped portion 92 of the front roller bracket 60. The bracket 310 has two arms 311 and 312 at right angles to each other. Both of these arms are secured to the inclined. U-shaped portion 92 by bolts that are threaded into the front roller bracket 60 to insure a solid connection. The edge guide bracket 310 also has a hub portion 313 with a bore 314 formed therein. A pivot shaft 316 is rotatably received in the bore 314. The pivot shaft is retained in the bore 314 by a collar 317 on one side and by a thrust washer 318 and spring clip 319 on the other side. Spring clip 319 is snapped into a groove formed in the pivot shaft 316. A coil spring 325 having one end secured in a hole formed in the pivot shaft 316, includes a coil portion 326 that is wrapped around the pivot shaft 316 and an arm portion 327 that extends across the bottom edge of the edge guide bracket 310. A swing arm 330 is secured by a screw 332 to the end portion of pivot shaft 316 that extends beyond the collar 317. The spring 325 causes the swing arm to swing up and toward the front. An edge guide 320 has a groove 322 formed therein that receives the free end of the swing arm 330. The edge guide 320 is secured to the swing arm 330 by a screw 323. The location of the swing arm 330 along the pivot shaft 316 can be adjusted through the screw 332 to thus move the edge guide 320 toward and away from the front feeder roller 86. When the edge guide 320 is in its operative position it is along side of the forward feed roller 86 and immediately above the throat plate 180. The swing arm 330 and edge guide 320 swings forward toward the material folding device when the forward feed roller is raised. While the edge guide 320 is in this forward position it functions as an edge guide for the material as it is being loaded into the folder and forced under the front feed roller. Since the edge guide 320 has maintained its lateral position relative to the front feeder roller 86 the material in the folder will be properly aligned.

Figure 22:
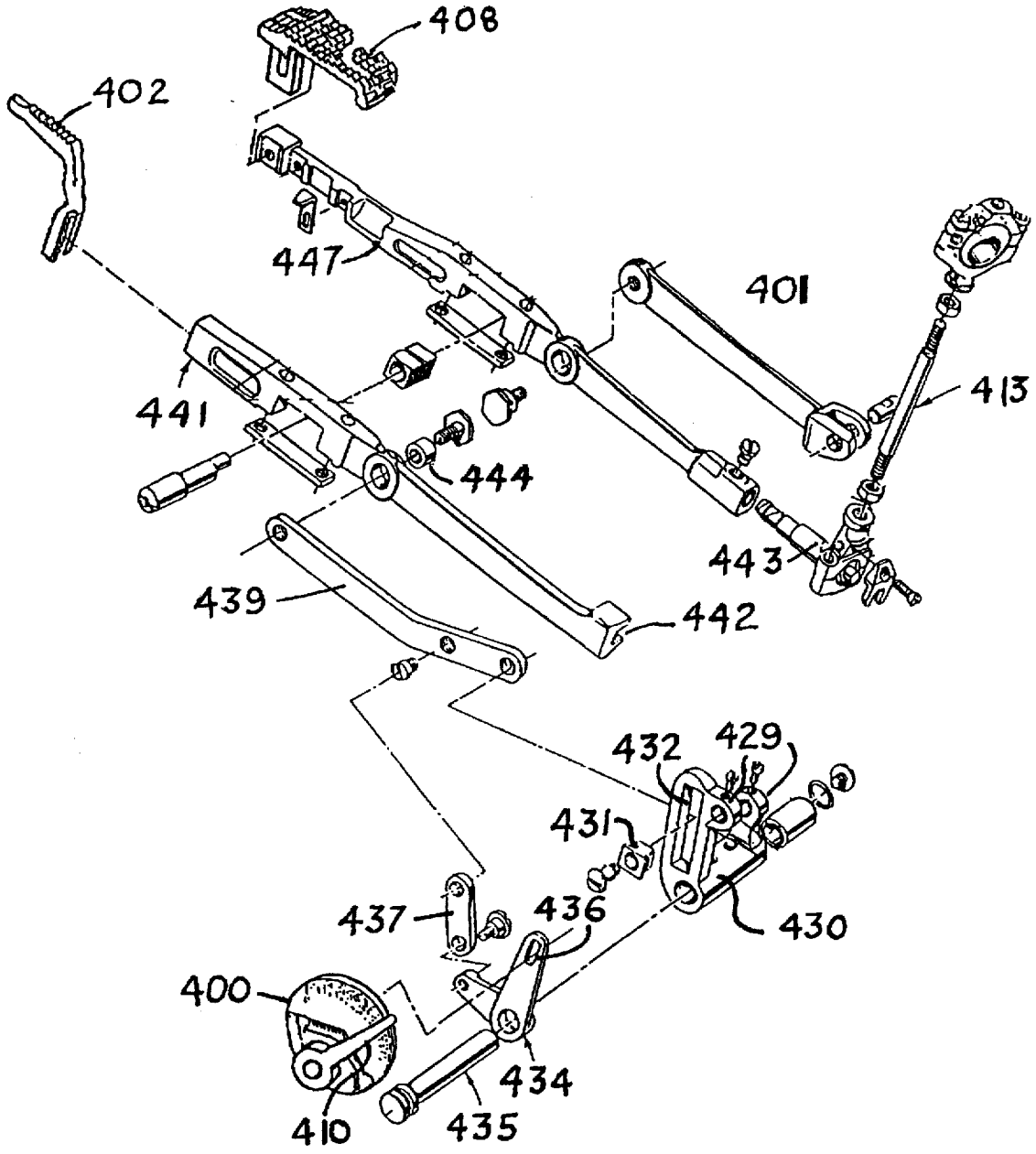
FIG. 22 is an exploded view of an embodiment of a differential feed dog mechanism.
Figure 23:
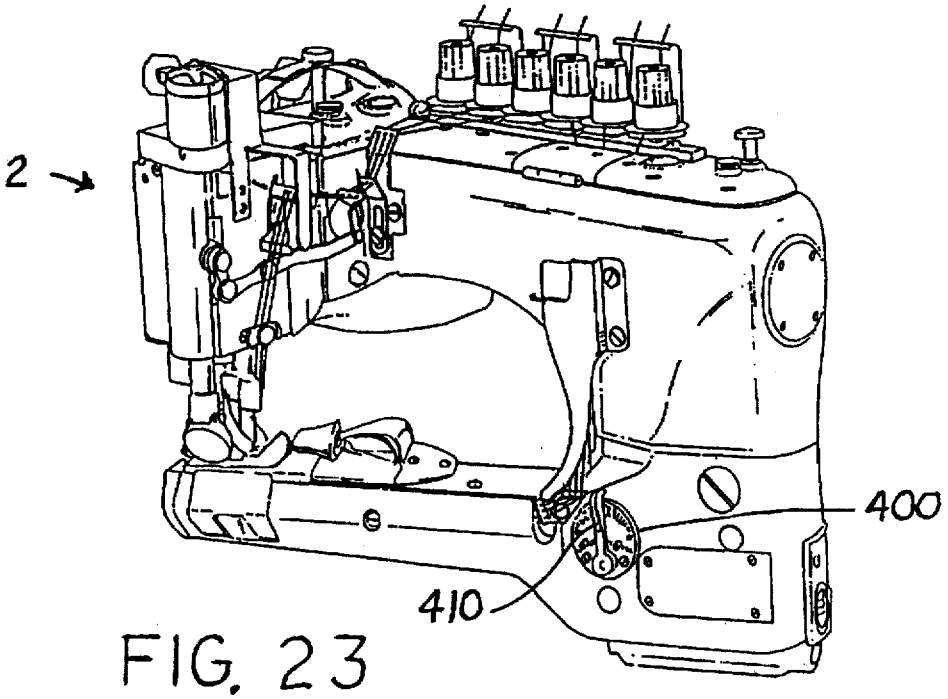
FIG. 23 is a perspective view of a sewing machine of the type that is used with this invention in which the control for the differential feed is shown.

Differential feed dogs are utilized for various purposes in a number of sewing operations. A differential feed mechanism for a sewing machine is disclosed for example in U.S. Pat. No. 4,436,045, which patent is hereby included by reference as a part of this disclosure. An embodiment of a differential feed dog mechanism is shown in FIG. 22. The main feed dog 408 is secured to the main feed bar 447 and the differential feed dog 402 is secured to the differential feed bar 441. The vertical movement that is imparted to both the main feed dog 408 and the differential feed dog 402 is the same and can not be changed. However, the horizontal or fore and aft movement of the differential feed dog 402 can be varied such that it is more or less than that of the main feed dog 408. The main feed bar 447 receives its vertical motion from crank mechanism 413 and its horizontal motion is controlled by arm 410. The vertical motion of the main feed bar 447 is transmitted to the differential feed bar 441 by the engagement of a claw 442 on the differential feed bar 441 with flat surfaces 443 on the main feed bar 447. As best seen in FIG. 23, a control 400 is provided on the sewing machine at a location that is convenient to the operator for adjusting the horizontal or fore and aft movement of the differential feed dog 402. This control 400 includes a pivoted arm 410 that can be grasp by the operator. The free end of the arm functions as a pointer that moves over indicia which represents the adjustment level. For example, at the twelve o'clock position the horizontal feed of the differential feed dog 402 is the same as the main feed dog 408, to the right of the twelve o'clock position indicates that the differential feed dog has a greater horizontal feed than the main feed dog 408 and to the left of the twelve o'clock position indicates that the differential feed dog has a smaller horizontal feed than the main feed dog 408. It should be noted that the sewing machine 2 shown in FIG. 23 is of the type that this invention is used with, however a conventions roller feed mechanism is shown in FIG. 23. The pivot arm 410 has a pivoted slide block (not shown) that sets in the slot 436 of bellcrank 434. Thus, adjustment of pivot arm 410 causes the bellcrank 434 to pivot about pivot shaft 435. The other arm of bellcrank 434 is connected through link 437 to lever 439. One end of lever 439 carries a pivoted slide block 431 that slides in slot 432 that is formed in oscillating member 430. The other end of lever 439 is connected through a bushing 444 to the differential feed bar 441. The oscillating member 430 receives its movement from a crank arm that is pivotally connected to collars 429. The crank arm (not shown) as is conventional is driven through an eccentric carried by the main drive shaft of the sewing machine. Through this mechanism adjustment of arm 410 causes slide block 431 to move along slot 432. The position of slide block 431 in slot 432 determines the amount of horizontal movement that will be transmitted to the differential feed dog 402. When the slide block 431 is located in the lower portion of the slot 432 close to pivot shaft 435 the lever arm for imparting motion to lever 439 is small and the amount of horizontal movement imparted to the differential feed dog 402 is correspondingly small. When the slide block 431 is located in the upper portion of the slot 432 the lever arm that imparts motion to lever 439 is large and the horizontal motion imparted to the differential feed dog 402 is accordingly greater.

Figure 24:
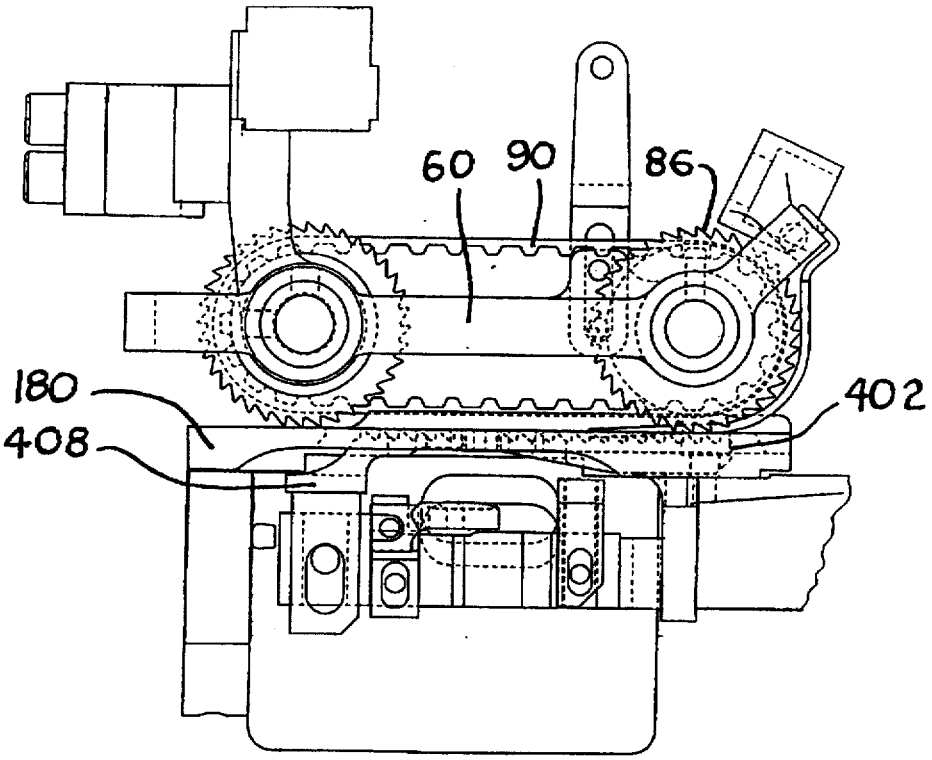
FIG. 24 is an issolated side view of the embodiment including the differential feed dog showing the relationship between the differential feed dog and the front roller.

As seen in FIG. 24 the differential feed dog 402 is located such that it is directly under the front roller 86. These components thus function as a driven upper feed, front roller 86, and a driven lower feed, differential feed dog 402. The stitch length of the differential feed dog 402 is set through the control 400. Usually the control 400 is set to produce the same number of stitch per inch as is being produced by the main feed dog 408. The front roller 86 contacts the top ply of the folded seam and the differential feed dog 402 contacts the bottom ply of the folded seam. Thus, if the amount of travel imparted by the differential feed dog 402 to the lower ply is changed in relation to the travel imparted by the front roller 86 to the upper ply, then the rate of feed of the top and bottom plies will vary. As previously explained by adjusting the arm 410 of the control 400 the amount of differential feed dog 402 travel can be increased or decreased in relation to the travel imparted to the upper ply by the front roller 86.

This feature of the invention is important to enable the operator to match the cross seam of the upper and lower plies. It is important for structural soundness of the garment, the proper fit and the appearance that the cross seams are aligned. This feature of the invention is also important because it permits the operator to match the top and bottom plies to come out even at the finish or end of the seam. In the prior art, both the alignment of the cross seam and matching the top and bottom plies at the finish, are objectives that the operator attempts to achieve by tugging and pulling on the top or bottom ply. In accordance with this invention the operator simply moves the control arm 410 of the control 400 to vary the feed rates between the top and bottom plies so that the cross seam will match and the ends come out even.

While the invention has heretofore been described in detail with particular reference to the illustrated apparatus, it is to be understood that variations, modifications and the use of equivalent mechanisms can be affected without departing from the scope of this invention. It is, therefore, intended that such changes and modifications be covered by the following claims.

What is claimed is:

1. A sewing machine including a sewing head and a lower arm;

a throat plate carried by said lower arm;

stitch forming mechanism including reciprocating needles mounted on said sewing head and a presser foot; a main bracket mounted on said sewing head such that it can be moved toward and away from said throat plate; a rear roller shaft journaled on said main bracket; a rear feeder roller secured to said rear roller shaft and disposed above said throat plate and to the rear of said presser foot;

a material folding device mounted on said lower arm forward of said throat plate for folding material to be fed to said stitch forming mechanism such that margins between edges of the material and the seam are established;

a front roller bracket connected to said sewing head; a front roller shaft journaled on said front roller bracket, a front feeder roller carried by said front roller bracket, said front feed roller functioning to receive the folded material from the folding device and positively feed the folded material into the stitch forming mechanism such that said margins are constant and the need for manually controlling the folded material is diminished;

an adjustable edge guide member mounted through mounting mechanism to said front roller bracket such that said adjustable edge guide is adjacent to said front feeder roller when said front roller bracket is in operative position and said adjustable edge guide swings forward toward said material folding device when said front roller bracket is raised, said adjustable edge guide functions as an edge guide for the material as said material is being loaded into said folder and under the front feeder roller when said adjustable edge guide is in the position it attains after swinging forward toward said material folding device, said adjustable edge guide member returns to the location adjacent to said front feeder roller when said front roller bracket returns to said front roller bracket operative position.

2. The invention as set forth in claim 1 wherein said mounting mechanism includes a bracket rigidly secured to said front roller bracket and extending forwardly therefrom;

a pivot shaft journaled in the forward end of said bracket, restraining devices to prevent axial movement of said pivot shaft relative to said bracket;

a swing arm is secured to said pivot shaft and carries said adjustable edgeguide at its free lower end;

a biasing device urging said pivot shaft to swings forward toward said material folding device when said front roller bracket is raised and returns to its location adjacent to said front feeder roller when said front roller bracket returns to its operative position.

3. The invention as set forth in claim 2 wherein said mounting mechanism for said adjustable edge guide member permits said adjustable edge guide member to be adjusted right and left of the row of stitches.

4. The invention as set forth in claim 2 wherein said mounting mechanism for said adjustable edge guide member permits said adjustable edge guide member to ride up and down relative to the front roller bracket.

5. A sewing machine for producing the rows of stitches for a felled seam including a sewing head and a work supporting surface;

stitch forming mechanism for forming a stitch in a stitch forming area, said stitch forming mechanism including needles mounted in said sewing head, a throat plate carried by said work supporting surface;

a main roller puller bracket mounted for reciprocal motion on said sewing head, a rear roller puller rotatably mounted on said main roller puller bracket about a generally horizontal axis, at a location rearward of said stitch forming area, a front roller bracket pivotally mounted on said main roller puller bracket about said generally horizontal axis, said front roller bracket having a forward portion, a front roller rotatably mounted on the forward portion of said front roller bracket at a location forward of said stitch forming area, drive mechanism for said rear and front rollers operable to drive them in a direction to advance the work product along a line of feed from front to rear;

a material folding device mounted on said work supporting surface forward of said throat plate for folding material to be fed to said stitch forming mechanism;

lifting mechanisms for raising and lowering said main roller puller bracket and the forward portion of said front roller bracket toward and away from said work supporting surface; and an adjustable edge guide member mounted through mounting mechanism to said front roller bracket such that it is adjacent to said front feeder roller when said front roller bracket is in operative position and said adjustable edge guide member swings forward toward said material folding device when said front roller bracket is raised and returns to its location adjacent to said front feeder roller when said front roller bracket returns to its operative position.

6. The invention as set forth in claim 5 wherein said mounting mechanism includes a bracket rigidly secured to said front roller bracket and extending forwardly therefrom;

a pivot shaft journaled in the forward end of said bracket, restraining devices to prevent axial movement of said pivot shaft relative to said bracket;

a swing arm secured to said pivot shaft, said swing arm carries said adjustable edge guide at its free lower end;

a biasing device urging said pivot shaft to swings forward toward said material folding device when said front roller bracket is raised and returns to its location adjacent to said front feeder roller when said front roller bracket returns to its operative position.

7. The invention as set forth in claim 6 wherein said mounting mechanism for said adjustable edge guide member permits said adjustable edge guide member to be adjusted right and left of the row of stitches.

8. The invention as set forth in claim 6 wherein said mounting mechanism for said adjustable edge guide member permits said adjustable edge guide member to ride up and down relative to the front roller bracket.

9. The method of producing rows of stitches having consistent lengths along a seam that encounters multiple layers of fabric and thick and bulky cross seams comprising the steps of:

(a) biasing a rear feed roller downwardly into contact with the upper surface of the work material rearward of the stitch forming area;

(b) biasing a front feed roller downwardly into contact with the upper layer of fabric, at a location forward of the stitch forming area and overlaying a differential feed dog;

(c) pushing said upper layer of fabric toward said stitch forming area, by said front feed roller, at a predetermined feed rate;

(d) adjusting said differential feed dog to push the lowest layer of fabric toward said stitch forming area at a selected feed rate that is equal to greater than or less than said predetermined feed rate;

(e) driving the rear and front feed rollers in a direction to pull and push, respectfully, the work material from and to the stitch forming area at said predetermined feed rate.

10. The method as set forth in claim 9 including the additional step of:

(f) driving the front feed roller from the rear feed roller in order to synchronize the magnitude of the pull and push that is being exerted on the work material.

11. The method as set forth in claim 9 including the additional step of:

(f) pivotally mounting the front feed roller through a front roller bracket on the rear feed roller such that the front roller can elevate and walk over the cross seam when it is encountered while continuing to provide positive feed to the work material.

12. The method as set forth in claim 10 including the additional step of:

(g) pivotally mounting the front feed roller through a front roller bracket on the rear feed roller such that the front roller can elevate and walk over the cross seam when it is encountered while continuing to provide positive feed to the work material.

13. The method as set forth in claim 9 including the additional step of:

(f) adjusting the biasing force on the front feed roller independently of the biasing force being applied to the rear feed roller; and (g) adjusting the biasing force on the rear feed roller independently of the biasing force being applied to the front feed roller.

14. The method as set forth in claim 11 including the additional step of:

(f) adjusting the biasing force on the front feed roller independently of the biasing force being applied to the rear feed roller; and (g) adjusting the biasing force on the rear feed roller independently of the biasing force being applied to the front feed roller.

15. A sewing machine including a sewing head and a lower arm;

a throat plate carried by said lower arm;

stitch forming mechanism including reciprocating needles mounted on said sewing head; a presser foot carried by said sewing head; a main bracket mounted on said sewing head such that it can be moved toward and away from said throat plate; a main feed dog mounted on said sewing machine in cooperative relationship with said presser foot; a rear roller shaft journaled on said main bracket; a rear feeder roller secured to said rear roller shaft and disposed above said throat plate and to the rear of said presser foot;

a front roller bracket connected to said sewing head; a front roller shaft journaled on said front roller bracket, a front feeder roller carried by said front roller bracket, said front feed roller functioning to receive the material and positively feed the material toward the stitch forming mechanism;

driving mechanisms for said rear and front feeder rollers;

a differential feed dog mounted on said sewing machine in cooperative relationship with said front feeder roller.

16. The invention as set forth in claim 15 wherein the invention further comprises:

drive mechanisms for said main feed dog and said differential feed dog that impart both vertical and horizontal components of movement thereto;

the drive mechanism for imparting the horizontal component of movement to said differential feed dog being variable through a control that is readily available to the operator during operation of the sewing machine to enable the operator to match the cross seam of the upper and lower plies and to match the top and bottom plies to come out even at the end of the seam.

17. The invention as set forth in claim 15 wherein said rear roller shaft is drivingly connected to said front roller shaft and the latter is driven by the former such that the front feeder roller is driven in synchronism with the rear feeder roller.

18. The invention as set forth in claim 15 wherein independent biasing mechanisms are provided for biasing said main bracket and said front roller bracket toward said sewing head.

19. The invention as set forth in claim 16 wherein said rear roller shaft is drivingly connected to said front roller shaft and the latter is driven by the former such that the front feeder roller is driven in synchronism with the rear feeder roller.

20. The invention as set forth in claim 16 wherein independent biasing mechanisms are provided for biasing said main bracket and said front roller bracket toward said sewing head.

* * * * *

UNITED STATES PATENT AND TRADEMARK OFFICE

CERTIFICATE OF CORRECTION

PATENT NO. : 5,694,876

DATED : December 9, 1997

INVENTOR(S) : Ackermann et al.

It is certified that error appears in the above-identified patent and that said Letters Patent is hereby corrected as shown below:

On the title page, item [56],
Under Other Publications, after "Union Special Catalog No. 95W, Class 35700," insert -- 35800 --.

Signed and Sealed this
Ninth Day of May, 2000

*Attest:*

*Attesting Officer*

Q. TODD DICKINSON

*Director of Patents and Trademarks*